US007827840B2

(12) United States Patent
Luckey, Jr. et al.

(10) Patent No.: US 7,827,840 B2
(45) Date of Patent: Nov. 9, 2010

(54) MULTISTAGE SUPERPLASTIC FORMING APPARATUS AND METHOD

(75) Inventors: S. George Luckey, Jr., Dearborn, MI (US); Peter A. Friedman, Ann Arbor, MI (US)

(73) Assignees: Ford Global Technologies, LLC, Dearborn, MI (US); Jaguar Cars Limited, Whitley, Coventry (GB)

( * ) Notice: Subject to any disclaimer, the term of this patent is extended or adjusted under 35 U.S.C. 154(b) by 897 days.

(21) Appl. No.: 11/565,048

(22) Filed: Nov. 30, 2006

(65) Prior Publication Data

US 2008/0127698 A1 Jun. 5, 2008

(51) Int. Cl.
*B21D 26/02* (2006.01)

(52) U.S. Cl. ..... 72/60; 72/57; 72/709; 29/421.1

(58) Field of Classification Search ..... 72/56, 72/57, 60, 709; 29/421.1
See application file for complete search history.

(56) References Cited

U.S. PATENT DOCUMENTS

| | | | | |
|---|---|---|---|---|
| 3,340,101 | A | 9/1967 | Fields, Jr. et al. | |
| 3,975,936 | A | 8/1976 | Baldwin et al. | |
| 4,045,986 | A | 9/1977 | Laycock et al. | |
| 4,266,416 | A | 5/1981 | Festag et al. | |
| 4,409,808 | A * | 10/1983 | Festag et al. | 72/60 |
| 4,901,552 | A | 2/1990 | Ginty et al. | |
| 4,936,128 | A | 6/1990 | Story et al. | |
| 5,647,239 | A | 7/1997 | Fischer | |
| 5,823,032 | A | 10/1998 | Fischer | |
| 5,916,316 | A | 6/1999 | Fischer | |
| 6,098,438 | A | 8/2000 | Fischer | |
| 6,253,588 | B1 | 7/2001 | Rashid et al. | |
| 6,615,631 | B2 | 9/2003 | Kleber et al. | |
| 6,672,121 | B2 | 1/2004 | Carsley et al. | |
| 6,880,377 | B2 * | 4/2005 | Kim et al. | 72/57 |
| 7,318,333 | B2 * | 1/2008 | Allor et al. | 72/60 |
| 7,363,790 | B2 * | 4/2008 | Kruger et al. | 72/57 |
| 7,389,665 | B1 * | 6/2008 | Luckey et al. | 72/60 |
| 2004/0074273 | A1 | 4/2004 | Kin et al. | |

FOREIGN PATENT DOCUMENTS

| | | |
|---|---|---|
| JP | 1197020 | 8/1989 |

* cited by examiner

*Primary Examiner*—David B Jones
(74) *Attorney, Agent, or Firm*—Tung & Associates; Raymond L. Coppiellie

(57) ABSTRACT

A superplastic forming apparatus and method for forming a sheet of material at an elevated temperatures into a workpiece having a complex geometry. The process takes advantage of a mechanical forming step, which draws material along a major axis to form a first preform. Upon completion of the first mechanical forming step, a second, initial superplastic forming step acts on the first preform to create a second preform having a plurality of channels or grooves located thereon. The grooves or channels function to draw additional material prior to the second or final gas forming step, which completes the forming process by driving the material against a forming surface. Accordingly, the method and apparatus function to reduce forming time and eliminate thinning and wrinkling of the sheet material during the forming process.

19 Claims, 4 Drawing Sheets

MULTISTAGE SUPERPLASTIC FORMING APPARATUS AND METHOD

CROSS-REFERENCE TO RELATED APPLICATIONS

Not applicable.

BACKGROUND OF THE INVENTION

1. Field of the Invention

The present invention relates generally to an apparatus and method for forming a workpiece; and more particularly, to a multistage forming apparatus that forms a sheet of material at an elevated temperature into a workpiece having a complex geometry.

2. Description of Related Art

Superplastic forming (SPF) is a process that takes advantage of a material's superplasticity or ability to undergo large strains under certain elevated temperature conditions. Superplasticity in metals is defined by very high tensile elongation and is the ability of certain materials to undergo extreme elongation at a predetermined temperature and strain rate. A simple example of superplastic forming is gas forming a sheet of material placed within a single-sided die set having a planar seal surface. The die and sheet of material, or as sometimes referred to the blank, are heated to a superplastic temperature and a predefined gas pressure profile is applied to one side of the sheet. The gas pressure forces the sheet into a die cavity and against a mold surface while maintaining a predetermined or target strain rate during the forming cycle.

Taking advantage of the superplasticity of the material enables forming of complex components not normally formed by conventional room temperature metal forming processes. For example, in the automotive industry it is often necessary to form components having deep cavities and very small radii. While superplastic forming enables forming such a component, one disadvantage is that it normally requires relatively long forming cycle times. Specifically, a conventional SPF process used to manufacture a complex part can require a forming cycle time as high as 30 minutes. Reducing these cycle times can result in necking and splitting when forming over small radii and excessive thinning of the part in certain areas such as the inside corners of concave parts or at the bottom of the mold cavity.

One way to address such problems includes prethinning the blank through a separate step prior to performing the superplastic forming process. Such a step can either include a mechanical step that draws additional material into the die cavity or a pre- or initial superplastic forming process that stretches or pre-thins a portion of the blank prior to the blank undergoing the final superplastic forming step. Depending upon the depth or configuration of the part, these additional steps typically require additional forming equipment, which increases costs, and in some instances may increases the forming time of the part.

While attempts have been made to combine a mechanical process for pre-forming the metal sheet or blank prior with a superplastic forming process such systems may require complicated pre-forming equipment that is expensive to manufacture, such as a double-action die set having a blank holder or binder assembly. Accordingly, there exists a need for a reduced complexity superplastic forming apparatus for forming metal sheet or blanks that combines the benefits of both mechanical and superplastic forming processes.

SUMMARY OF THE INVENTION

The present invention is a multistage superplastic forming apparatus and method for forming a sheet of material at an elevated temperature. The apparatus includes a forming tool having an upper or pre-form die and a lower or forming die that moves between a first, open position and a second, closed position. Both the upper die and lower die include a die surface and a periphery. The periphery of each die being non-planar, wherein the non-planar periphery of the upper die is complementary to the non-planar periphery of the lower die. The forming tool further includes the upper die having a draw member and the lower die having a die cavity and a forming surface. Passageways extend through each of the upper die and lower die to the respective die surfaces and allow fluid of the type used in a superplastic forming process to travel through each of the upper die and lower die to their respective die surfaces.

In a further embodiment of the invention, the upper die surface includes a recess therein forming a die cavity in the upper die surface. The recess configured such that material from the metal sheet placed between the respective upper and lower die during the first or initial gas forming process or step creates an additional preform that aids in material distribution during the final gas forming step. Depending upon the configuration and placement of the recess, initial gas forming step draws the material of the metal sheet in a multitude of directions. Accordingly, the apparatus provides a single-action forming tool operative to draw metal into the die cavity along multiple axes using upper and lower dies and without the use of a blank holder.

The present invention further includes a method for multistage superplastic forming. The method includes providing a single-action forming tool having an upper die and a lower die with the upper die and lower dies operative to move between a first, open position and a second, closed and sealed position. After placing a heated metal sheet between the upper and lower dies, the dies are moved from the first, open position to the second, closed and sealed position whereby they draw metal into a die cavity of the forming tool. In one embodiment, first the single-action forming tool mechanically draws metal substantially along a major axis after which an initial superplastic forming step draws metal along a different axis. Both steps are taken before the final superplastic forming step forms a workpiece from the preform created by the foregoing steps.

DETAILED DESCRIPTION OF THE PREFERRED EMBODIMENTS

Figure 1:
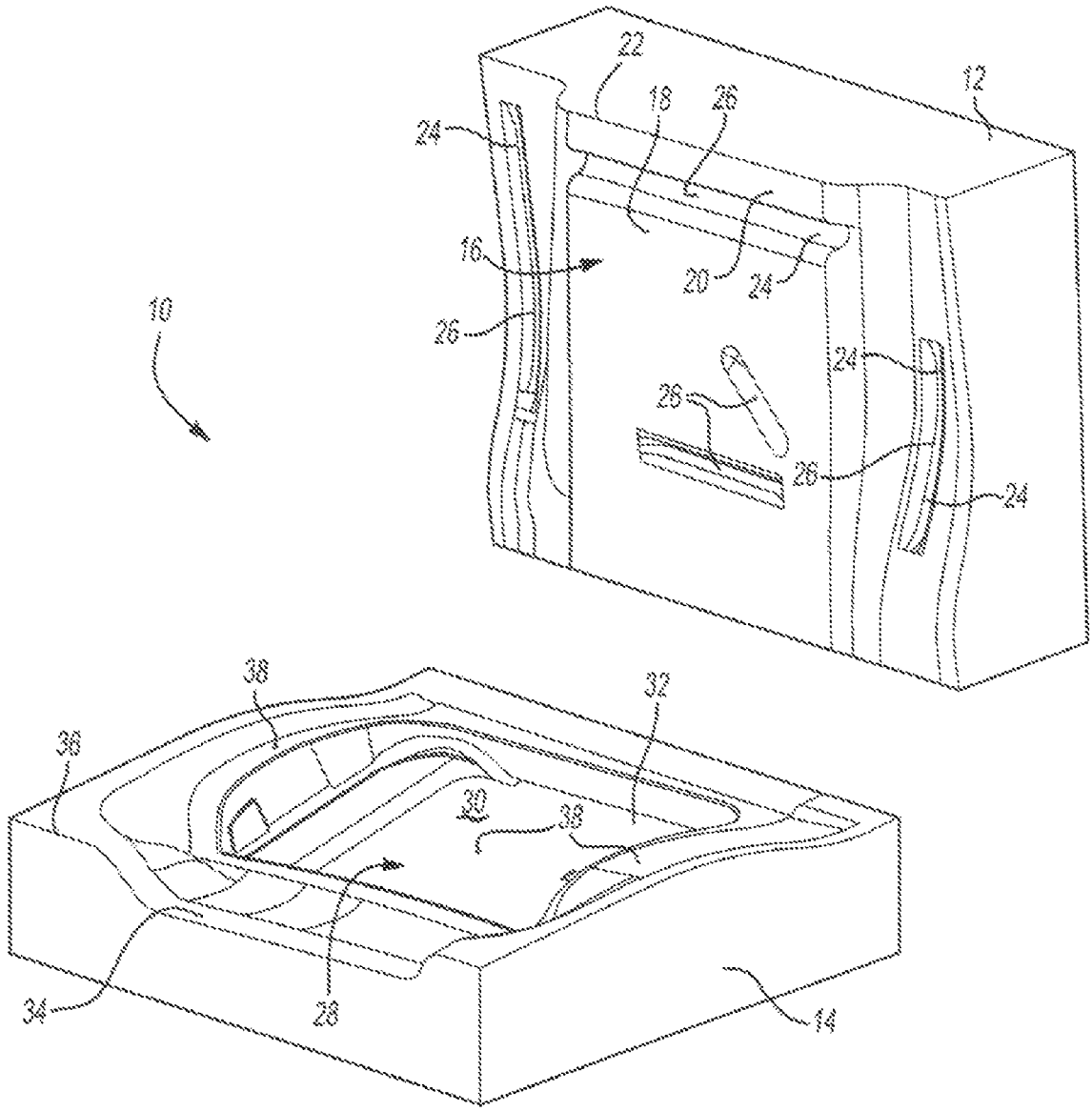
FIG. 1 is a perspective view of a forming tool used for superplastic forming a workpiece according to the present invention.
Figure 2:
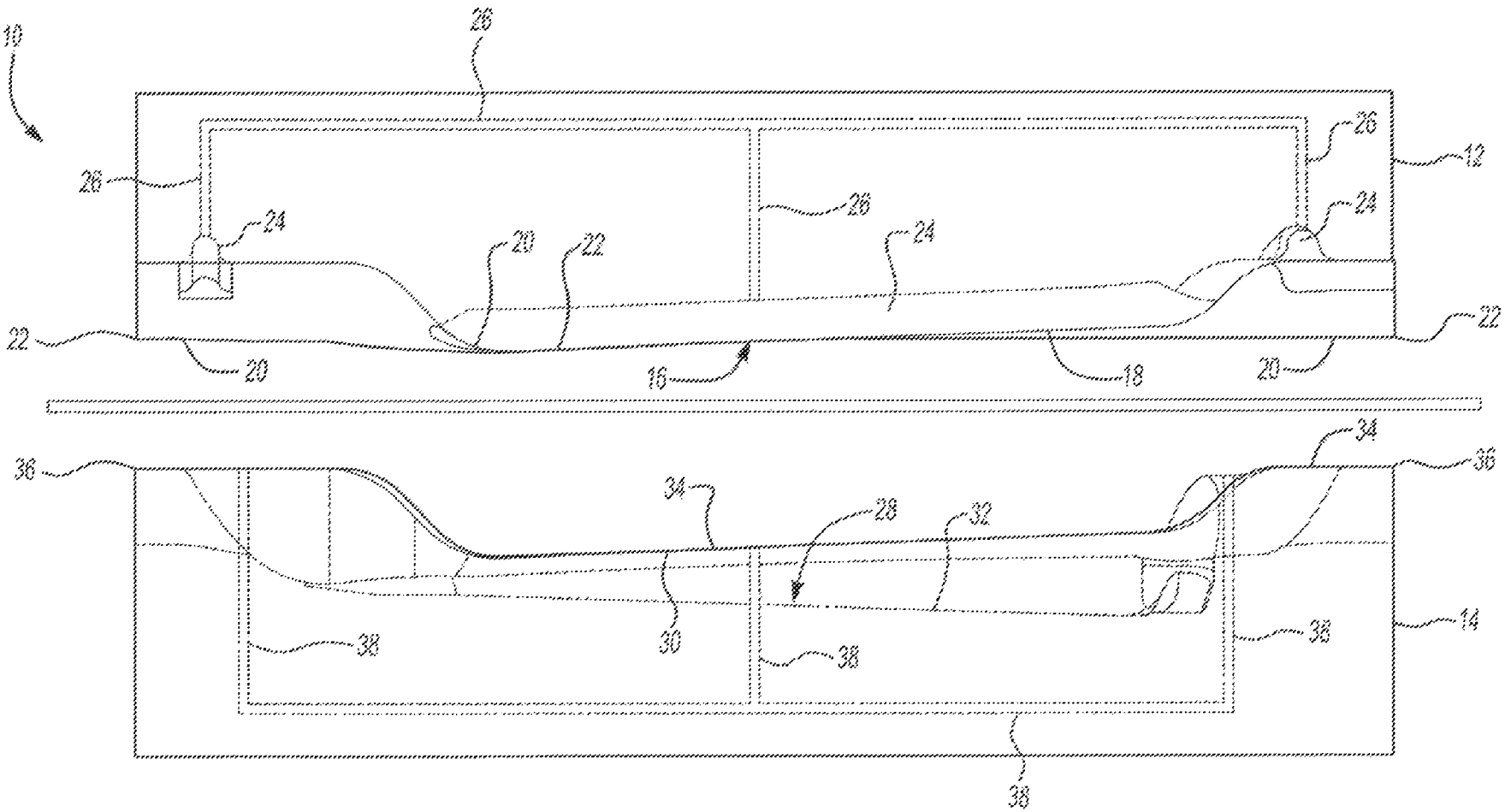
FIG. 2 is a front view of the forming tool illustrated in FIG. 1.

Referring now to the drawings, FIGS. 1-2 illustrate a single-action forming tool 10 according to the present invention used for forming a flat metal sheet or blank 11. The term single-action describes the use of upper and lower dies that act on the blank when closing as opposed to a double-action tool that utilizes a separate blank holder or binder to hold the metal sheet during the draw process. The forming tool 10 includes an upper or pre-forming die 12 and a lower or forming die 14. The upper or pre-forming die 12 and the lower or forming die 14 are operative to move between an open and a closed position.

The upper die 12 includes a die or forming surface 16. The die surface 16 includes a punch or draw member 18 and a periphery 20 having a non-planar configuration. Wherein the periphery 20 is a region or zone of the die surface 16 adjacent, the outer edge 22 of the upper die 12. The die surface 16 of the upper die 12 further includes a plurality of recesses 24 illustrated as semi-cylindrically shaped channels or grooves. These recesses 24 form a die cavity in the upper die 12. A plurality of passageways 26 extend through the upper die 12 to the die surface 16. The passageways 26 connect to a gas pressure source (not shown) enabling pressurized gas to flow from the gas pressure source to the die surface 16 of the upper die 12.

The lower or forming die 14 includes a die or forming surface 28. The lower or forming die 14 further includes a die cavity 30 having a forming surface 32. The die surface 28 further including a periphery 34 having a non-planar configuration. Once again, the periphery 34 is a region or zone of the die surface 28 adjacent the outer edge 36 of the upper die 14. A plurality of passageways 38 extend through the lower die 14 to the die surface 28 of the lower die 14. The passageways 38 connect to the gas pressure source (not shown) enabling pressurized gas to flow from the gas pressure source to the die surface 28 of the upper die 14. As known in the art, the gas pressure source supplies pressurized gas used to perform a superplastic forming process according to one aspect of the present invention. Various gases can be used, the type typically depending upon the composition of the material being formed. In addition, U.S. Patent Application Publication No. US 2006/0260373 A1 discloses a method for forming a workpiece by applying pressure through passageways located in upper and lower dies of a superplastic forming tool, the disclosure and contents of which is hereby incorporated by reference in its entirety.

In accordance with the present invention, the periphery 20 of the upper die 12 and the periphery 34 of the lower die 14 come together to form a non-planar binder that imparts a non-planar configuration to the metal sheet or blank. In addition, the punch or draw member 18 cooperates with the die cavity 30 to draw additional material from the periphery of the metal sheet or blank into the die cavity 30. Accordingly, the single-action forming tool 10 mechanically pre-bends or pre-forms the metal sheet or blank 11 positioned between the upper and lower dies 12, 14 as the upper and lower dies 12, 14 move from the open position to the closed position. When placed in the closed position, the upper and lower dies 12, 14 sandwich the metal sheet or blank 11 between the die surface 16 of the upper die 12 and the die surface 28 of the lower die 14.

In accordance with the method of the present invention, the single-action forming tool 10 utilizes both mechanical forming and gas forming to form a metal sheet or blank. In the preferred embodiment, a three-stage process forms the metal sheet or blank into a finished workpiece. The three-stage process includes a mechanical forming step along with first and second gas forming steps. During the mechanical forming stage, a planar blank or flat sheet of material 11 is placed between the upper and lower dies 12, 14. When closed, the upper and lower dies 12, 14 cooperate to draw material from the blank or sheet 11 to create an initial or first preform 40, see FIG. 3. As the upper die 12 approaches the lower die 14, the punch or draw member 18 engages the metal sheet 11 and draws additional material into the die cavity 30. Since the single-action forming tool 10 does not use a blank holder, when the forming tool 10 starts to close the punch or draw member 18 engages the metal sheet 11 and pulls at least a portion of the metal sheet 11 into the die cavity 30 in an unrestricted manner.

Figure 3:
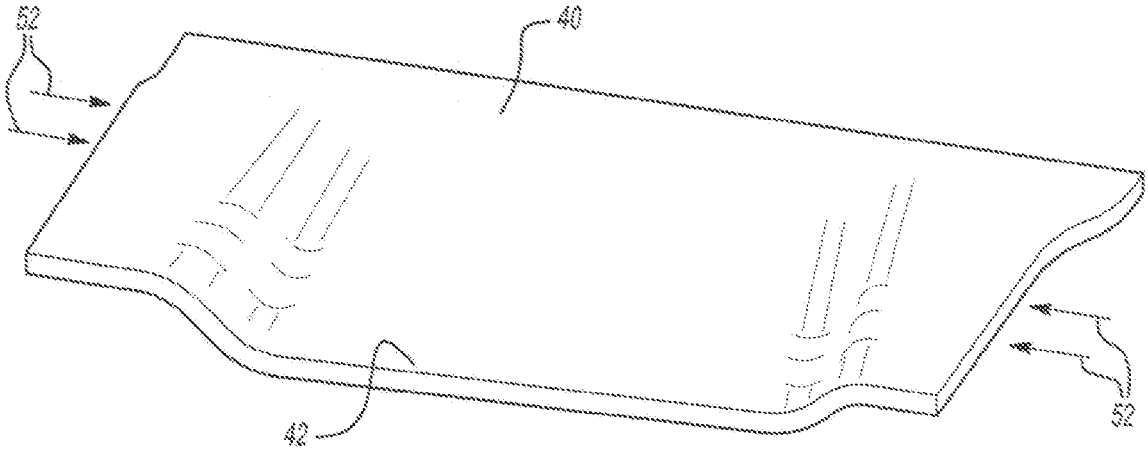
FIG. 3 is a perspective view of a preform formed according to an initial step of one embodiment of the present invention.

As the forming tool 10 continues to close, the periphery 20 of the upper die 12 and the periphery 34 of the lower die 14 come together and bend or form the metal sheet 11 to create the initial or first preform 40. As illustrated in FIG. 3, the initial preform 40 has a periphery 42 having a configuration conforming to the non-planar configuration of the peripheries 20, 34 of the respective upper and lower dies 12, 14. Since the forming die 14 also performs the superplastic forming steps, the respective peripheries 20, 34 of the upper die 12 and lower die 14 are complementary to one another. Accordingly, once they form the periphery 42 of the first preform 40, the upper and lower dies 12, 14 sandwich the periphery 42 of the preform 40 between them and form a seal after closing the forming tool 10.

As shown, the first preform 40 has a non-planar periphery 42 mechanically formed according to a first stage of the present invention. During the first mechanical preforming stage, the forming tool 10 engages and bends or curves the blank or metal sheet 11 in a manner whereby the material of the blank is drawn primarily along one dominant axes, as illustrated by the arrows 52, to create the first preform 40. The dominant axes being the axis receiving the primary bend or curvature necessary to form the preform. By performing the mechanical preforming stage without a blank holder, significant mechanical pre-forming; i.e., bending or curving the blank 11, is limited to predominantly single-curve shapes. An attempt to draw or pull a significant amount of the material of the blank 11 in more than one direction without using a binder or blank holder typically causes material wrinkling in a flange portion of the component due to the circumferential stresses occurring there.

Figure 4:
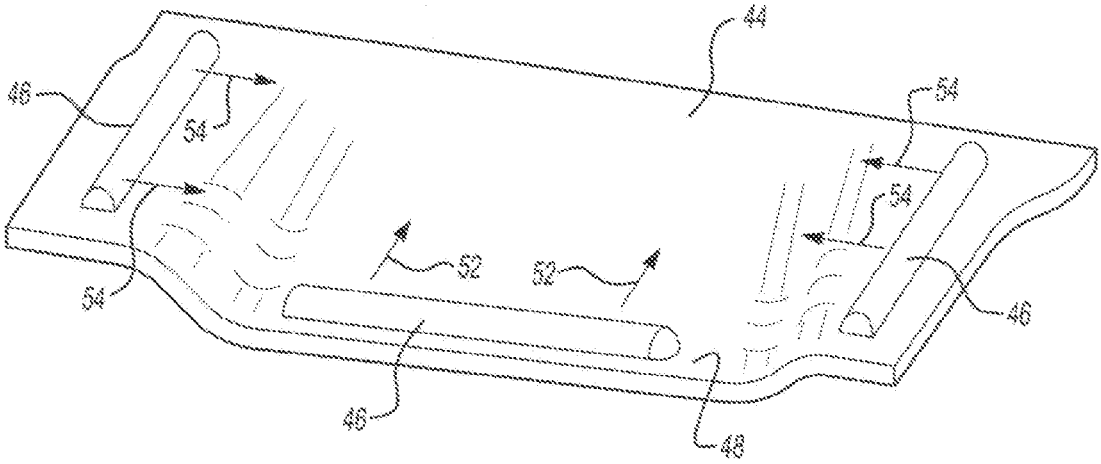
FIG. 4 is a perspective view of a preform formed according to an initial superplastic forming step of one embodiment of the present invention.

FIG. 4 illustrates a second preform 44 created upon completion of the second stage. During the second stage, with the forming tool 10 fully closed and sealed, gas pressure is supplied to one side of the first preform 40 through the passages 38 located in the lower or forming die 14. The gas pressure drives a portion of the first preform 40 upward against the die surface 16 of the upper or preform die 12 and into the semi-cylindrically shaped channels or grooves 24 located in the upper or prefrom die 12. Accordingly, the second stage utilizes a superplastic forming process to form the second preform 44 with multiple semi-circular channels 46 extending along pre-determined lines or locations in the preform 44. The semicircular channels 46 may also be located in the periphery 48 of the second preform 44. Thus, the second stage forms a second preform 44 that is pre-stretched in certain areas.

Figure 5:
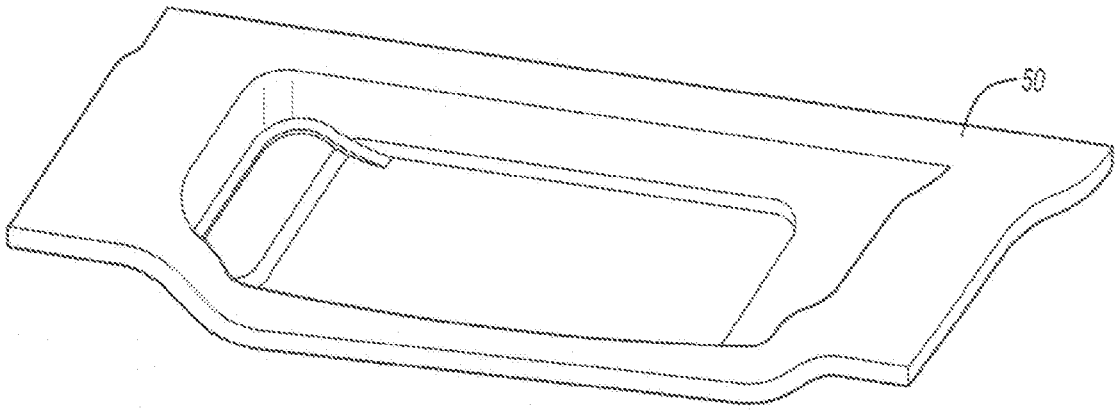
FIG. 5 is a perspective view of a metal sheet formed according to a subsequent superplastic forming step of one embodiment of the present invention.

FIG. 5 illustrates a part or workpiece 50 created during the third and final forming stage of the process. The third stage includes a second gas forming stage wherein gas pressure is supplied through passageways 26 located in the upper or preform die 12. The gas pressure acts on the side of the second preform 44 opposite the die cavity 30 and drives a portion of the second preform 44 downward against the forming surface 32 of the forming die 14. Driving the second preform 44 into the die cavity 30, draws or pulls the material of the semi-cylindrically shaped channels 46 into the die cavity 30 in the direction of the arrows 54. As known with superplastic gas pressure preforming, the additional length or amount of material created by the gas pre-forming step helps to reduces excessive thinning of the final part or workpiece 50 as the workpiece is formed over small radii and at the bottom of the die cavity 30.

Combining both mechanical and gas preforming in a single-action forming tool 10 minimizes necking or excessive thinning around radii by using the combination to draw metal into the die cavity 30 along multiple axes without the use of a blank holder. While the mechanical pre-forming stage draws the material of the blank in predominantly one axis, the second gas pre-form stage creates a second preform 44 configured such that during the third or final forming stage material of the second preform 44 is drawn or pulled into the die cavity 30 along multiple axes. Thus, the forming tool 10 according to the present invention is operative to pull or draw material along a plurality of axes using a single-action superplastic forming tool 10 that takes advantage of a mechanical forming process to decrease overall forming time. Accordingly, the present invention utilizes a three-stage forming tool 10 and process that operates with a standard single-action press. Simplifying the forming tool 10 in this manner correspondingly reduces costs and complexity of the forming tool while decreasing overall forming time. Further, the present invention contemplates tailoring the preform design to prevent part thinning and improve the overall thickness profile of the part or workpiece 50.

Figure 6:
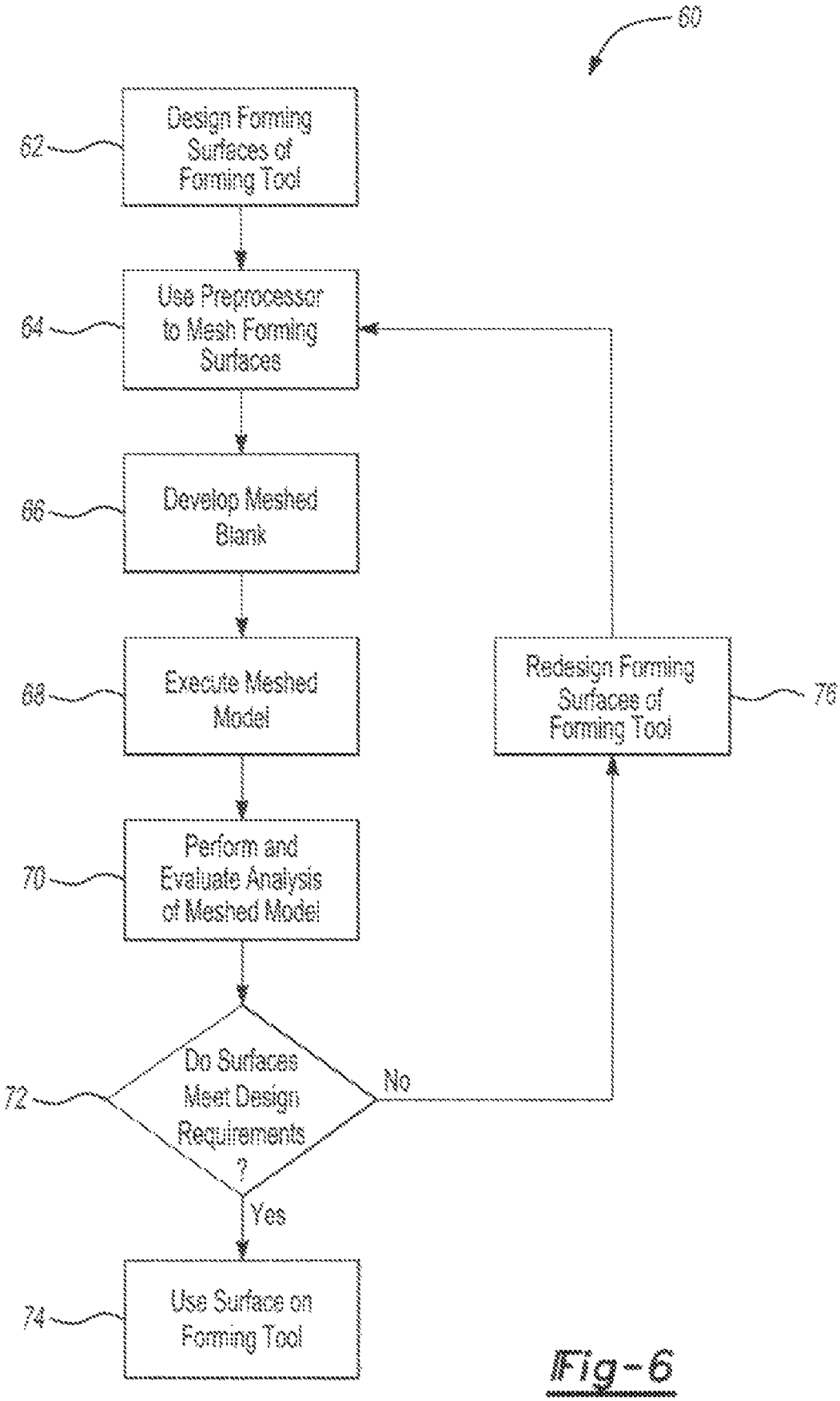
FIG. 6 is a flowchart illustrating a method for designing a superplastic forming tool according to one embodiment of the present invention.

FIG. 6 illustrates a flowchart according to the present invention setting forth the steps for establishing the die surfaces 16, 28 of the respective upper or preform die 12 and lower or forming die 14. In particular, the method involves designing or configuring the respective die surfaces 16, 28 such that they create a preform having a configuration that controls material flow within the forming tool 10 during the forming process. Further, the preform is designed to control material distribution in the forming tool 10 and thus correspondingly control material thickness. The method utilizes in part, the step of conducting a finite element analysis to model sheet metal forming parameters in order to determine the design of the preform. The method combines the need to develop both a forming surface used with the first mechanical forming process to initially shape the preform and a forming surface used with the first gas forming processes that provides the preform with additional elements or further shape. One embodiment includes adding elements to the preform to pre-stretch the preform. Accordingly, the method includes using a gas forming process to create or form channels in the mechanically formed preform. While disclosed herein as semi-circular channels, these additional elements or structure in the preform created by the gas forming process may take a plurality of shapes, configurations or designs. The shape, configuration or design of the elements formed in the preform by the initial gas forming process depend ultimately upon the final configuration and shape of the forming surface 32 located in the lower or forming die 14.

The method 60 for creating the forming surfaces of the superplastic forming tool 10 is generally shown in FIG. 6. As shown therein, block 62 illustrates the first step of utilizing a computer-aided design program to design a particular to pre-selected forming surface. The forming surfaces 16, 28 of each of the upper or pre-form die 12 and lower or forming die 14 are typically designed with a three dimensional computer-aided design system, many of which are commercially available. While the forming surface 16 of the upper or pre-form die 12 has an empirically designed shape or configuration used to create the preform, the forming surface 28 of the lower forming die 14 is shaped or configured to produce the end part or workpiece 50. Block 64 shows the next step of using a preprocessor such as HyperMesh®, available from Altair Engineering, Troy Mich., to mesh the forming surfaces using shell elements.

Block 66 illustrates the step of developing a meshed blank formed using shell elements and applying the appropriate boundary conditions and load steps to the blank elements. Block 68 illustrates the next step of developing an input finite element analysis cardfile and executing the meshed model. Block 70 illustrates the next step wherein upon completion of the finite element analysis of the meshed model the results thereof are analyzed for excessive thinning and wrinkling of the blank member during the forming process. As illustrated in block 72, if the results of the analysis meet the design requirements, that is, a satisfactory workpiece 50 can be formed with the selected die surfaces 16, 28 then the method moves to block 74 wherein these surfaces are used on the forming tool 10. If, however, the design of the upper or the die surfaces 16, 28 are not satisfactory, then the method goes to the step of block 76, which includes redesigning the forming surfaces of the forming tool 10 after which the method starts again with use of a preprocessor to mesh the newly designed forming surfaces as illustrated in block 64.

The above method takes into consideration frictional conditions occurring during superplastic forming. The frictional conditions are highly dependent on the material of the metal sheet, die surface roughness and any solid lubricant used during the forming process. The coefficient of friction can range between 0.15 and 0.5 and is established experimentally for conditions specific to the particular forming operation. In addition, the boundary conditions are also problem or workpiece dependent. For example, modeling the clamping of the sheet between the upper or pre-form die 12 and lower or forming die 14 used to form the superplastic forming chamber or die cavity 30 can be defined by constraining the edges of the sheet in a major direction transverse the blank edges.

A number of constitutive models have been developed for describing the stress, strain, strain rate and grain size relationship for superplastic and hot-plastic materials; however, with the careful development of the coefficients, the empirical power law equation given below has been demonstrated to accurately and efficiently describe the high temperature deformation behavior of aluminum and magnesium.

$$\sigma = K\hat{\epsilon}^m \epsilon^n$$

Where $\sigma$ is the flow stress, $\hat{\epsilon}$ is the strain rate, $\epsilon$ is the strain, K is a constant, m is the strain rate sensitivity exponent, and n is the strain hardening exponent.

Accordingly, one aspect of the present invention enables the design of the die surfaces 16, 28 of the upper or preform die 12 and lower or forming die 14 to create a preform that controls material flow of the metal sheet during the final, superplastic forming portion of the workpiece thereby preventing excessive thinning and distributing material as necessary. In addition, the invention includes a single-action forming tool 10 that utilizes both a mechanical forming process and a gas forming process to control material flow within the forming tool and distribute material within the forming tool to maintain desired material thickness.

What is claimed is:

1. A superplastic forming tool comprising:

an upper die and a lower die, said upper and lower dies operative to move between a first, open position and a second, closed position;

said upper die including a die surface and a periphery, said periphery being non-planar;

said lower die including a die surface and a periphery, said periphery being non-planar such that said non-planar periphery of said upper die is complementary to said non-planar periphery of said lower die;

said upper die including a draw member;

said lower die having a die cavity and a forming surface; and said upper die having at least one passageway therein, said passageway communicating with said die cavity in said lower die wherein said upper die and said lower die cooperate together without using a blank holder to initially form a workpiece.

2. A superplastic forming tool as set forth in claim 1 including said die surface of said upper die having at least one recess therein, said recess forming a die cavity in said upper die; and said upper die further having a passageway extending from said recess, said passageway enabling fluid flow to and from said recess.

3. A superplastic forming tool as set forth in claim 1 wherein said draw member extends into said die cavity in said lower die as said upper and lower dies are placed in said second, closed position.

4. A superplastic forming tool as set forth in claim 1 wherein said non-planar periphery of said upper die and said non-planar periphery of said lower die exert a force on a metal sheet disposed between said upper die and said lower die to form a seal between said upper die and said lower die when said upper die and said lower die are placed in said second, closed position.

5. A superplastic forming tool as set forth in claim 4 wherein said lower die includes a passageway extending therethrough and communicating with said die cavity in said lower die.

6. A superplastic forming tool as set forth in claim 4 including said die surface of said upper die having at least one recess therein said recess forming a die cavity in said upper die; and said upper die further having a passageway extending from said recess, said passageway enabling fluid flow to and from said recess.

7. A superplastic forming tool as set forth in claim 4 wherein said draw member extends into said die cavity when said upper die and said lower die are placed in said second, closed position.

8. A method of forming a metal sheet comprising the steps of:

providing a forming tool, the forming tool including an upper die and a lower die, said upper die and said lower die operative to move between a first, open position and a second, closed position;

placing a metal sheet between the upper die and the lower die when said upper die and said lower die are in the open position;

creating a first preform by moving the upper die and the lower die to the second, closed position wherein said metal sheet is sandwiched between the upper die and the lower die;

creating a second preform by applying fluid pressure against a surface of the metal sheet to urge the metal sheet into a recess located in the upper die;

applying fluid pressure against a surface of the metal sheet to urge the metal sheet into a die cavity located in the lower die;

using a draw member located on the upper die to draw a portion of the metal sheet into the die cavity; and using the upper die and the lower die to form the blank with a non-planar periphery.

9. A method of forming a metal sheet as set forth in claim 8 including the step of mechanically preforming the blank with a non-planar periphery.

10. A method of forming a metal sheet as set forth in claim 8 wherein the step of using a draw member to draw a portion of the metal sheet into the die cavity includes the step of drawing the metal sheet along one substantially dominant axis.

11. A method of forming a metal sheet as set forth in claim 10 wherein the step of creating a second preform includes the step of using a superplastic forming process to draw a portion of the metal sheet along an axis other than said substantially dominant axis.

12. A method of forming a metal sheet as set forth in claim 8 including the step of utilizing a superplastic forming process to create the second preform prior to completing the forming process by urging the second preform against a forming surface located in the die cavity of the lower die.

13. A method of forming a metal sheet as set forth in claim 8 including the step of providing the upper die with a non-planar periphery and the lower die with a non-planar periphery, wherein the step of creating a first preform includes using the non-planar periphery of the upper die and the non-planar periphery of the lower die to impart a non-planar configuration to a periphery of the first preform; and using a draw member located on the upper die to draw a portion of the metal sheet into the die cavity in the lower die as the upper die and the lower die travel from the first, open position to the second, closed position.

14. A method of forming a metal sheet as set forth in claim 13 including the step of maintaining a seal between the upper die and the lower die such that a sealed die cavity is formed on each side of the metal sheet.

15. A method of forming a metal sheet comprising the steps of:

providing a single-action forming tool, the forming tool including an upper die and a lower die said single-action forming tool operative to function without a blank holder, said upper die and said lower die operative to move between a first, open position and a second, closed and sealed position;

placing a heated metal sheet between the upper die and the lower die when said upper die and said lower die are in the first, open position;

moving the upper die and the lower die from the first, open position to the second, closed and sealed position and using the single-action forming tool to draw metal into a die cavity of the forming tool along multiple axes.

16. A method of forming a metal sheet as set forth in claim 15 including the steps of:

providing the upper die with a die surface having a preconfigured non-planar periphery and draw member, the upper die having at least one recess therein forming a die cavity; and providing the lower die with a die surface having a preconfigured non-planar periphery and a die cavity wherein the non-planar periphery of the upper die and the non-planar periphery of the lower die are complementary such that they sandwich the metal sheet between them and form a seal about a periphery of the metal sheet when the forming tool is placed in the second, closed and sealed position.

17. A method of forming a metal sheet as set forth in claim 16 including the step of using a superplastic forming process that first drives the metal sheet against the die surface of the upper die and then drives the metal sheet away from the die surface of the upper die and against the die surface of the lower die.

18. A method of forming a metal sheet as set forth in claim 16 including the steps of:

utilizing three-dimensional computer aided design software to initially design the die surface of the upper die and the lower die;

exporting the forming surfaces into suitable preprocessor software and meshing the forming surfaces using shell elements;

developing a meshed blank using boundary conditions; and developing a finite element analysis, executing the analysis with a meshed model and evaluating the results.

19. A method of forming a metal sheet as set forth in claim 18 wherein the step of evaluating the results includes reviewing the results for excessive thinning and wrinkling of the formed metal sheet; and modifying the forming surfaces of the upper die and lower die until the forming surfaces produce a formed metal sheet that meets design requirements.

* * * * *

UNITED STATES PATENT AND TRADEMARK OFFICE

CERTIFICATE OF CORRECTION

PATENT NO. : 7,827,840 B2
APPLICATION NO. : 11/565048
DATED : November 9, 2010
INVENTOR(S) : S. George Luckey, Jr. and Peter A. Friedman It is certified that error appears in the above-identified patent and that said Letters Patent is hereby corrected as shown below:

On the Title page item (57), In the Abstract, Line 2, kindly delete "temperatures" and replace with --temperature--.

In Column 3, Line 33, kindly delete "upper" and replace with --lower--.

In Column 3, Line 38, kindly delete "upper" and replace with --lower--.

Signed and Sealed this
Twenty-second Day of February, 2011

David J. Kappos

David J. Kappos
*Director of the United States Patent and Trademark Office*